US010337669B2

(12) United States Patent
Mercer et al.

(10) Patent No.: US 10,337,669 B2
(45) Date of Patent: Jul. 2, 2019

(54) SUBTERRANEAN SEALED TANK WITH VARYING WIDTH

(71) Applicant: Ocean's NG, LLC, Edmond, OK (US)

(72) Inventors: Ronald R. Mercer, Nichols Hills, OK (US); John Herbert Bolte, Joplin, MO (US); Anthony Richard Tiehen, Oklahoma City, OK (US)

(73) Assignee: OCEAN'S NG, LLC, Edmond, OK (US)

( * ) Notice: Subject to any disclaimer, the term of this patent is extended or adjusted under 35 U.S.C. 154(b) by 65 days.

(21) Appl. No.: 15/581,813

(22) Filed: Apr. 28, 2017

(65) Prior Publication Data

US 2017/0314362 A1 Nov. 2, 2017

Related U.S. Application Data

(60) Provisional application No. 62/329,857, filed on Apr. 29, 2016.

(51) Int. Cl.
*E21B 33/14* (2006.01)
*F17C 1/00* (2006.01)

(52) U.S. Cl.
CPC ..... *F17C 1/007* (2013.01)

(58) Field of Classification Search
CPC ..... F17C 1/007; F17C 2201/01; F01C 2201/0123
See application file for complete search history.

(56) References Cited

U.S. PATENT DOCUMENTS

| | | | | | |
|---|---|---|---|---|---|
| 2,066,517 | A * | 1/1937 | Campbell | A62C 13/70 | 169/11 |
| 2,332,462 | A * | 10/1943 | Nilson | F17C 1/04 | 220/586 |
| 3,205,665 | A | 9/1965 | Van Horn | | |
| 3,352,116 | A * | 11/1967 | Waterman | B65D 88/76 | 138/148 |
| 4,805,674 | A * | 2/1989 | Knowlton | F17C 5/06 | 141/39 |
| 5,207,530 | A | 5/1993 | Brooks et al. | | |
| 5,333,465 | A | 8/1994 | McBride | | |
| 6,840,709 | B2 | 1/2005 | Dahlem et al. | | |
| 9,109,751 | B2 | 8/2015 | Schimp | | |
| 9,127,812 | B2 * | 9/2015 | Ronchieri | F17C 1/14 | |
| 2008/0131258 | A1 | 6/2008 | Liepold et al. | | |
| 2013/0336721 | A1 * | 12/2013 | McBride | E21D 11/00 | 405/55 |
| 2014/0161533 | A1 * | 6/2014 | Oates | B65G 5/005 | 405/56 |
| 2015/0330569 | A1 * | 11/2015 | Fitzpatrick | F17C 1/02 | 206/0.6 |

* cited by examiner

*Primary Examiner* — Benjamin F Fiorello
(74) *Attorney, Agent, or Firm* — Hall Estill Attorneys at Law; Tyler J. Mantooth

(57) ABSTRACT

A subterranean tank can consist of at least a casing string that has a containment section disposed between first and second end regions. The containment section may have a first width while each of the first and second end regions have a second width. The first width can be greater than the second width of the respective first or second end regions. The entire casing string may be sealed to maintain a gas at 5,000 psi or more until a gas delivery assembly attached to the first end region releases gas stored in the casing string.

19 Claims, 2 Drawing Sheets

SUBTERRANEAN SEALED TANK WITH VARYING WIDTH

RELATED APPLICATION

The present application makes a claim of domestic priority to U.S. Provisional Patent Application No. 62/329,857 filed Apr. 29, 2016, the contents of which are hereby incorporated by reference.

SUMMARY

A subterranean gas storage system, in accordance with various embodiments, has a casing string with a containment section disposed between first and second end regions. The containment section has a first width while each of the first and second end regions have a second width. The first width is greater than the second width of the respective first or second end regions. The entire casing string is sealed to maintain a gas at 5,000 psi or more until a gas delivery assembly attached to the first end region releases gas stored in the casing string.

In some embodiments, first and second subterranean tanks each have a subterranean tank that consists of a casing string having a containment section disposed between first and second end regions. The containment section has a first width while each of the first and second end regions have a second width where the first width is greater than the second width of the respective first or second end regions. The entire casing string is sealed to maintain a gas at 5,000 psi or more until a gas delivery assembly attached to the first end region releases gas stored in the casing string Other embodiments drill a bore into a ground surface to a depth of 500 ft. or more prior to positioning a casing string in the bore. A casing string consists of a containment section disposed between first and second end regions. The containment section has a first width while each end region has a second width where the first width is greater than a first uniform width. A gas is then sealed in the casing string at a pressure of 5,000 psi or more before being released from the casing string with a gas delivery assembly that delivers the gas to a vehicle with the gas delivery assembly.

DETAILED DESCRIPTION

Assorted embodiments of the present disclosure are directed to a fuel storage and delivery system that can safely store gas, such as natural gas or other gaseous fuels, in a subterranean bore at pressures of 5,000 psi or greater. The ability to store natural gas at relatively high pressures allows less subterranean sealed bores to service greater numbers of gas fueled vehicles, such as compressed natural gas (CNG) vehicles, compared to tanks that are maintained at relatively low pressures and/or low volumes.

Throughout the disclosure, the term "tank" is meant as a non-naturally occurring pressure vessel that is defined by a man-made material. For instance, a subterranean tank can consist of metal casing sealed on opposite ends. A "sealed bore" is hereby meant as a naturally occurring, or artificially created, hole extending underground that is sealed proximal to ground level. For example, a sealed bore can be an underground cave or an oil and gas exploration aperture that is sealed with a feature, such as a valve or cover. In some embodiments, a tank is positioned in a sealed bore and is constructed of metal casing plugged at one in and sealed at ground level by at least one valve.

It is noted that the term "subterranean" is meant as a completely underground structure that may be connected to an above ground structure, but is wholly located below a ground surface. For example, a tank may be partially positioned below a ground surface without being a subterranean storage tank while a tank positioned with substantially all, such as above 95% of the tank structure, below ground can be considered a subterranean storage tank.

Figure 1:
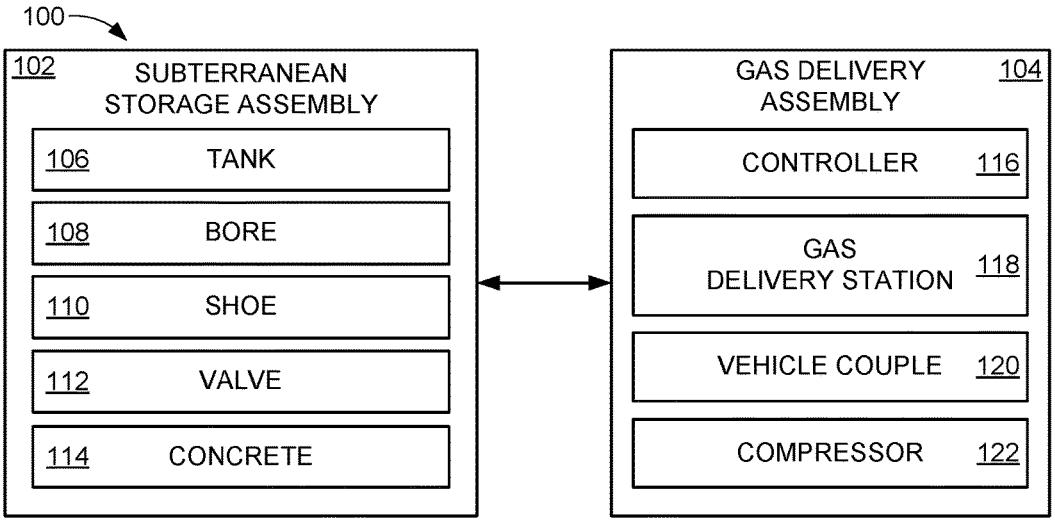
FIG. 1 is a block representation of an example subterranean fuel storage system arranged in accordance with various embodiments.

FIG. 1 is a block representation of an example subterranean storage system 100 that can safely store relatively large volumes of gaseous fuel, such as natural gas, in accordance with various embodiments. A fuel storage system 100 may comprise any number of subterranean storage assemblies 102 that individually, or collectively, communicate with a gas delivery assembly 104 to provide fuel, such as natural gas, to a vehicle at regulated rates and volumes. Each subterranean storage assembly 102 can have at least one tank 106 positioned in a man-made well bore 108. A tank 106 is sealed on a deeper bottom side by a bottom hole assembly 110 (SHOE), which is comprised of a high pressure plug, tank, and chemically resistant epoxy resin, and on an above ground side by a valve 112 while the entire structure is secured in the bore 108 by concrete 114.

The valve 112 can be selected by a controller 116 of the gas delivery assembly 104 to allow fuel to flow from the tank 106 to a gas delivery station 118 that regulates the flow of fuel to a vehicle via a vehicle couple 120. The gas delivery assembly 104 may utilize one or more compressors 122 to increase the pressure from the tank 106 to a vehicle. The controller 116 of the gas delivery assembly 104 may also direct one or more compressors 122 to operate to increase the pressure in the tank 106 of the subterranean storage assembly 102. It is contemplated that a separate controller can direct the supply and compression of fuel into the tank 106 independently of operation of the gas delivery assembly 104.

Figure 2:
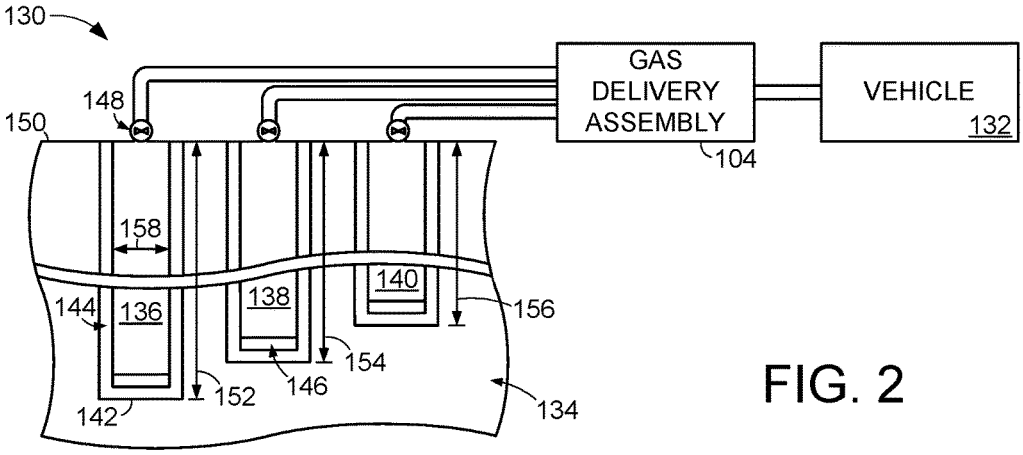
FIG. 2 represents a portion of an example fuel delivery system that may employ the subterranean fuel storage system of FIG. 1 in accordance with assorted embodiments.

FIG. 2 illustrates a side view of an example fuel delivery system 130 that may operate with the fuel storage system 100 of FIG. 1 to efficiently store and deliver fuel to one or more vehicles 132. The fuel delivery system 130 can employ a single bore or an array of subterranean sealed bores 134 that has a plurality of separate tanks 136, 138, and 140 each positioned in a well bore 142 and held in place by a concrete reinforcement 144. Each tank 136, 138, and 140 has a bottom hole assembly 146 that seals a downhole region and a valve 148 that seals a ground region so that the space between the respective bottom hole assembly 146 and valve 148 combinations is air-tight, water-tight, and capable of holding pressure for an extended period of time, such as weeks or years.

In the non-limiting embodiment of FIG. 2, the respective tanks continuously extend from a ground surface 150 to different depths 152, 154, and 156. While the various tanks may extend to a common depth, the ability to tune the depth of a sealed bore 142 to common or different depths can decrease installation time and cost while accommodating the fuel storage capacity and delivery needs. Regardless of how the depths of the respective tanks are configured, it is contemplated that each tank 136, 138, and 140 will have a smaller width 158 at the top and bottom of the tank than in the middle of the tank. The well bores in which the respective tanks reside may have a uniform, or varying, width from the ground surface 150 to the total depth. It is noted that a uniform width 158 may be different between different tanks.

Figure 3:
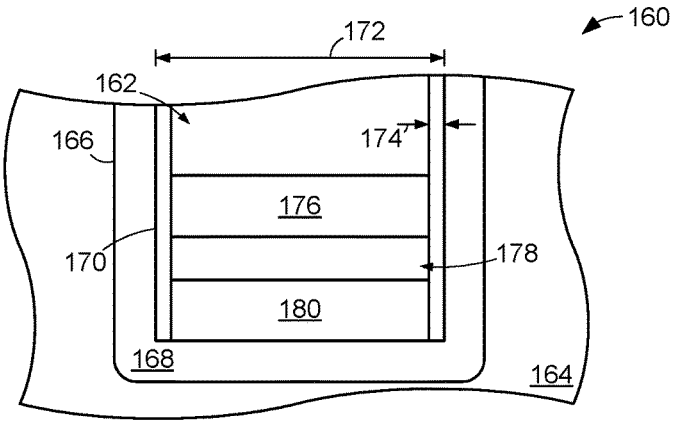
FIG. 3 displays a line representation of a portion of a subterranean sealed bore configured in accordance with some embodiments.

By constructing a tank with a customized width 158, construction and installation can be simplified by using downhole exploration casing. In yet, for large diameter casing, such as greater than 9.625 inches outside diameter, it can be difficult to effectively seal the tank well enough to sustain tank pressures of 5,000 psi or more for an extended period of time. FIG. 3 displays a line representation of a bottom hole assembly portion of an example subterranean sealed bore 160 arranged in accordance with some embodiments to allow a tank 162 to sustain pressures of 5,000 psi or more.

It is noted that the tank 162 is positioned in a subterranean formation 164 by being secured in a subterranean well bore 166 by a rigid material 168, such as concrete and/or cement. The tank 162 is constructed of a combination of steel casing 170 sections of varying diameter 172 that have a wall thickness 174 conducive to pressures of 5,000 psi or greater. The downhole region of the tank 162 that is located proximal the termination of the bore 166 is sealed top-to-bottom by first 176, second 178, and third 180 seals. It is contemplated that the first seal 176 is an epoxy resin, the second seal 178 is a high pressure bridge plug, and the third seal 180 is cement or resin.

Although the thickness and material of the respective seals 176, 178, and 180 can be adjusted to plug and seal the tank 162 at some pressures, the diameter, wall thickness, and yield strength of the casing 174 has been found as a determining factor on how much pressure a tank 162 can hold, regardless of the configuration of the seals 176, 178, and 180. That is, the seals 176, 178, and 180 can be configured in many different ways to seal an approximately 9.625 inch or less diameter 174 casing to hold a 5,000 psi or more pressure, but no currently available seal configuration has been found to hold a 7,500 psi pressure for casing outside diameters 174 larger than approximately 9.625 inches outside diameter.

As a result, the volume and safety factor of the tank 162 is limited by the ability to seal the downhole region of the tank 162 or the yield strength of the casing 170, whichever is the lesser working pressure rating. It is noted that as the casing diameter 172 increases above 9 inches outside diameter, the force exerted on the walls of the casing 170 by gas stored at 5,000 psi or more and contained by various seals 176, 178, and 180 can compromise the integrity of the casing 170 and increase the risk of failure. Accordingly, assorted embodiments are directed to subterranean sealed bore systems capable of maintaining 5,000 psi or more internal pressure by keeping the downhole portion of a tank to a 9.625 inches or less casing outside diameter while increasing the width of a different portion of the tank.

Figure 4:
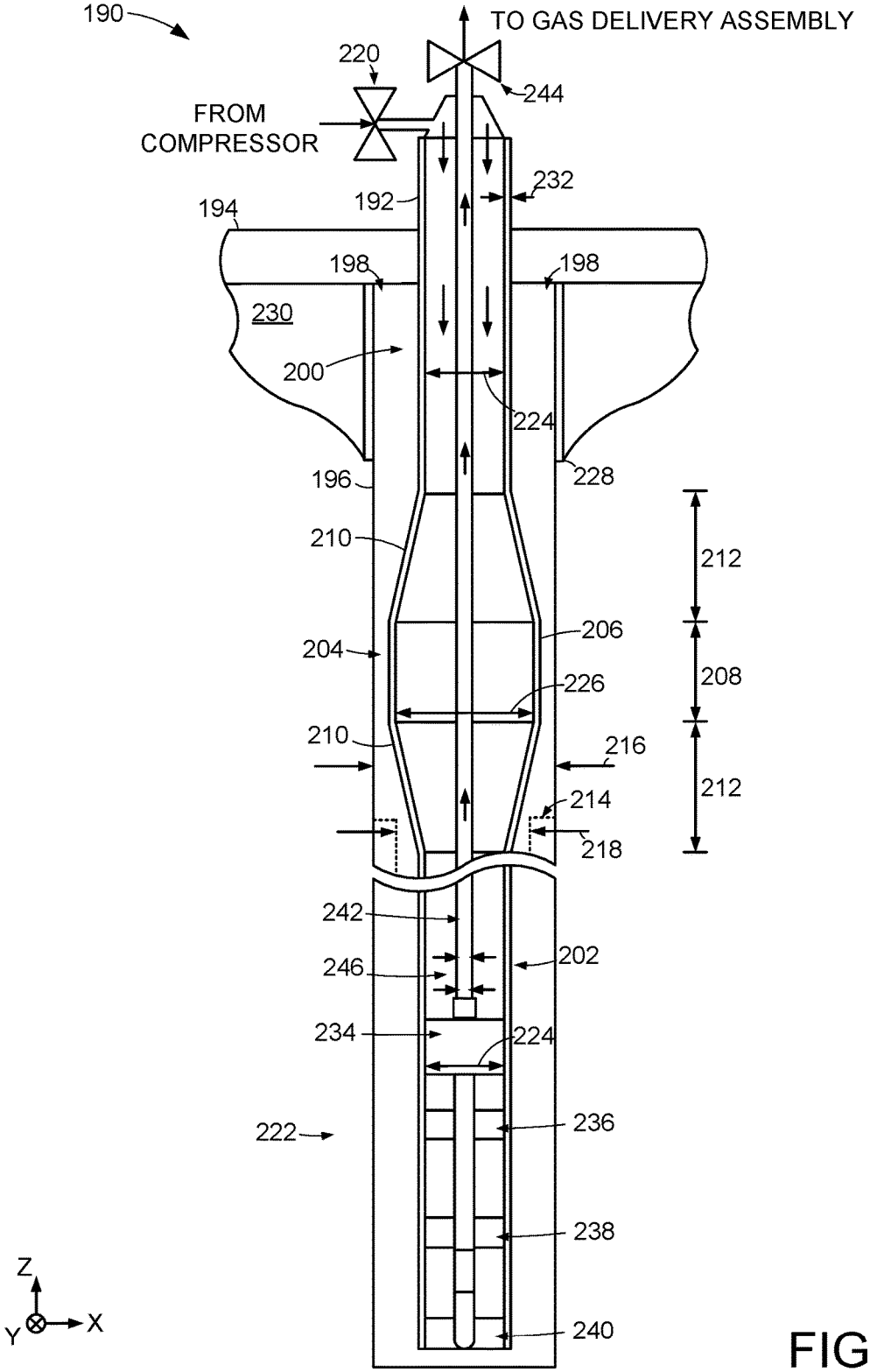
FIG. 4 shows a line representation of an example subterranean sealed tank capable of being utilized in the fuel delivery system of FIG. 2.

FIG. 4 provides a cross-sectional line representation of a portion of an example subterranean sealed tank 190 that can be utilized in the systems 100 and 130 of FIGS. 1 and 2 in accordance with various embodiments. The subterranean sealed tank 190 consists of a casing string 192 continuously extending from a ground level 194 to an underground depth, such as 500 feet or greater. The casing string 192 is secured within a bore 196 by a retention layer 198 that may be a single material, such as concrete, or an aggregate of multiple different materials, such as rock, cement, and soil. The retention layer 198 continuously extends from an uphole end region 200 of the casing string 192 to a downhole end region 202.

The casing string 192 has a containment section 204 disposed between the uphole 200 and downhole 202 end regions. The containment section 204 can take on any shape, size, and position. Although not required or limiting, the containment section 204 can be configured with a body portion 206 that has a first length 208 and is disposed between coupling portions 210 that each have a second length 212, such as 3 feet, that is greater than the first length 208. The respective coupling portions 210 can have matching, or dissimilar, dimensions that are configured to position the body portion 206 closer to the bore sidewall, which serves to trap the material of the retention layer 198 and secure the casing string 192 in place.

In some embodiments, the bore 192 may consist of multiple different bore diameters that are connected with a transition surface 214, such as the larger uphole bore diameter 216 decreasing to the smaller downhole bore diameter 218 illustrated by segmented lines. However, a uniform single bore diameter 216 can be utilized in other embodiments.

The shape of the containment section 204 and retention layer 198 along with the configuration and proximity of a transition surface 214, if included, to the containment section 204 can increase the retention of the casing string 192 within the bore 196 in the event of a upward pressure on the casing string 192, such as from a gas leak or explosion. When a transition surface 214 in included, the position of the transition surface 214 downhole to reside within the areal extent of the containment section 204, as defined by the collective lengths of 208 and 212, allows the containment section 204 to more securely engage the retention layer 198 against the sidewall of the bore 196, including the transition surface 214, than if the casing string 192 had a uniform casing width and the bore 196 had a uniform bore width, which is generally illustrated in FIG. 2.

In the non-limiting embodiment of FIG. 4, the uphole end region 200 is sealed with a valve 220 and the downhole end region 202 is sealed by a downhole assembly 222. The size, shape, and position of the containment section 204 allows the end regions 200/202 to each have widths 224 that can be support a 5,000 psi internal bore pressure with a heightened safety factor while providing an overall larger fuel storage capacity with the containment section having a larger width 226. In other words, the containment section 204 allows a 9.625 inch outside diameter casing width at the end regions 200 and 202, which can be safely sealed to 5,000 psi or more, and allows a greater volume of fuel per linear foot to be stored at the same pressure in the containment section 204 than if a uniform diameter casing was utilized. In contrast, equivalent fuel storage volumes could be attained by having a uniform width casing that has a diameter larger than 9.625 inches, but such casing diameters would decrease the safety factor of the sealed tank 190 at test pressures that exceed 5,000 psi.

The containment section 204 also provides increased safety for a subterranean sealed bore by increasing the physical retention capability of the casing 192 within the well bore 196. For example, the increased containment section width 204 provides a sort of physical cleat that keeps the casing string 192 from lifting out of the well bore 196 in the event of a pressure release, rupture, or drastic increase in pressure downhole, which would result in upward force on the casing string 192. In some embodiments, the containment section width 204 is tuned to maximize the physical retention capability of the well bore 196. The larger width of the containment section 204 complements the end regions by adding physical retention to the smaller diameter of the upper and lower casing diameters 224 to allow 5,000 psi or greater internal casing pressures with optimized safety factors.

The relationship between bore diameter 216 and casing diameter 224/226 is critical in retaining the casing string 192 in the bore 196. In other words, the size, shape, and construction of the retention layer 198 between the casing string 192 and bore sidewalls determines how easy it is for the entire casing string 192 to lift out of the ground over time, such as in the event of a sudden increase in pressure. In the uphole region 200, the change in casing size serves to contain the casing string 192 within the bore 196 in the event of a failure of the bottom hole assembly 222. In the downhole region 202, the change in casing size allows an increase in the thickness of rigid material to plug and seal the casing to provide a pressured gas storage vessel. The increased uphole casing diameter 224 can accommodate the larger containment section width 226, which can be approximately 13.375 inches outside diameter in some embodiments.

It is contemplated that the casing string 192 can be supported proximal the ground surface 194 by supplemental casing 228 that separates a portion of the bore 196 from a ground formation 230. In some embodiments, the supplemental casing 228 extends approximately 40-50 feet in depth below ground level 194. It is noted that while the casing string 192 has varying widths 224 and 226, the thickness of the casing wall 232 will be rated and tested to exceed 6,250 psi (or 5,000 psi plus an operating margin of 1.25). For example, the containment section 204 and end portions 200 and 202 can each employ different casing diameter and thickness, but will be working pressure rated to ensure gas storage pressures of at least 6,250 psi can be safely maintained.

With the smaller width 224 of the downhole end portion 202, a number of different bottom hole assembly 222 configurations can be utilized to safely store gaseous fuel, such as natural gas, at 5,000 psi or more in the casing string 192. In the non-limiting embodiment of FIG. 4, a resin section 234 is upstring of a high pressure bridge plug 236, a tank float collar 238, and a cement layer 240 that collectively fills and seals the lower portion of the bottom hole assembly to a float shoe positioned on the bottom of the casing string 192. It is contemplated that the various seals can contact one another or, as shown, be separated by a material that is dissimilar from the seals, such as cement and/or resin.

Tubing 242 continuously extends from just above the bottom hole assembly 222 to an exit valve 244, which may be part of a tree valve arrangement with at least one pressure relief mechanism. The tubing 242 has openings to allow differential pressure inside the casing string 192 to transmit stored gas to the exit valve 244. It is noted that the containment section 204 and end portions 200 and 204 can collectively form a casing string that partially extends above the ground surface 194, but can be characterized as a subterranean storage container due to a vast majority (>95%) of the storage capacity of the casing string being below the ground surface 194.

The casing string 192 may extend a predetermined depth within the bore 196, such as 1500' or deeper, with the containment section 204 having a greater width 226 than either end region 200/202. A portion of the intake valve and end portion are positioned in an open pit, or trench, which is depressed below a ground level. It can be appreciated that the various commentary on materials and sizes in FIG. 4 are merely exemplary and are not meant to limit the possible configurations of a subterranean sealed bore. For example, the containment section 204 can have a length, as measured parallel to the depth of the bore, that is greater than the 1-200 feet shown in FIG. 4.

Through the various embodiments of a variable width casing string 192, a subterranean sealed tank 190 can safely store more gaseous fuel, such as natural gas, at 5,000 psi working pressure or more than a string having a uniform casing diameter of more than approximately 9.625 inches. The utilization of a smaller casing diameter at uphole 200 and downhole 202 end regions of the casing string 192 allows a bottom hole assembly 222 to more reliably seal the casing string greater than 5,000 psi while allowing the containment section 204 to provide increased storage capacity. Additionally, the containment section can be configured to provide at least a minimum casing wall thickness 232 and yield strength despite enlarging the diameter 226 of the casing string 192, which provides added safety to a system that is designed to consistently be pressurized at and above 5,000 psi with combustible fuel.

It is to be understood that even though numerous characteristics and configurations of various embodiments of the present disclosure have been set forth in the foregoing description, together with details of the structure and function of various embodiments, this detailed description is illustrative only, and changes may be made in detail, especially in matters of structure and arrangements of parts within the principles of the technology to the full extent indicated by the broad general meaning of the terms in which the appended claims are expressed. For example, the particular elements may vary depending on the particular application without departing from the spirit and scope of the present disclosure.

What is claimed is:

1. An apparatus comprising a casing string having a containment section disposed between first and second end regions, the containment section comprising a uniform diameter body disposed between first and second couplers, the first and second couplers each having variable diameters, the containment section having a first width, each of the first and second end regions having a second width, the first width being greater than the second width of the respective first or second end regions, the entire casing string sealed to maintain a gas at 5,000 psi or more until a gas delivery assembly attached to the first end region releases gas stored in the casing string.

2. The apparatus of claim 1, wherein the second width is 9.625 inches measured to an outside surface of the casing string.

3. The apparatus of claim 1, wherein the first width is 13.375 inches.

4. The apparatus of claim 1, wherein the casing string is positioned within a bore, the bore having a uniform bore width from a ground level to proximal the second end region.

5. The apparatus of claim 4, wherein the containment section is closer to a sidewall of the bore than the first or second end regions.

6. The apparatus of claim 1, wherein the each coupler has a first length and the body has a second length, the first length being greater than the second length.

7. The apparatus of claim 1, wherein the casing string holds gas at 6,250 psi.

8. The apparatus of claim 1, wherein the casing string is sealed at the second end region by a bottom hole assembly.

9. The apparatus of claim 8, wherein the bottom hole assembly comprises a resin section, a plug, a float collar, and a cement layer, the resin section physically separated from the plug, float collar, and cement layer, the plug physically separated from the float collar and cement layer, the float collar physically separated from the cement layer.

10. The apparatus of claim 8, wherein the casing string is positioned within a bore and separated from an inner surface of the bore by concrete.

11. A system comprising first and second subterranean tanks each subterranean tank comprising a casing string having a containment section disposed between first and second end regions, the containment section comprising a uniform diameter body disposed between first and second couplers, the first and second couplers each having variable diameters, the containment section having a first width, each of the first and second end regions having a second width, the first width being greater than the second width of the respective first or second end regions, the entire casing string sealed to maintain a gas at 5,000 psi or more until a gas delivery assembly attached to the first end region releases gas stored in the casing string.

12. The system of claim 11, wherein the first subterranean tank is positioned in a first bore and the second subterranean tank is positioned in a second bore, the first and second bores being physically separate.

13. The system of claim 12, wherein the first bore has a different diameter than the second bore.

14. The system of claim 11, wherein the first subterranean tank continuously extends from a ground level to a first depth, the second subterranean tank continuously extends from the ground level to a second depth, the first depth being different than the second depth.

15. The system of claim 11, wherein the first and second subterranean tanks are each connected to a single gas delivery assembly.

16. The system of claim 11, wherein the first casing string has a casing length continuously extending from a ground level, a tube continuously extending the casing length within the first casing string.

17. The system of claim 16, wherein the tube extends to an exit valve positioned exterior to the casing string and above a ground level.

18. A method comprising:

drilling a bore into a ground surface to a depth of 500 ft. or more;

positioning a casing string in the bore, the casing string comprising a containment section disposed between first and second end regions, the containment section comprising a uniform diameter body disposed between first and second couplers, the first and second couplers each having variable diameters, the containment section having a first width, each end region having a second width, the first width being greater than a first uniform width;

sealing a gas in the casing string at a pressure of 5,000 psi or more;

releasing the gas from the casing string with a gas delivery assembly; and delivering the gas to a vehicle with the gas delivery assembly.

19. The method of claim 18, further comprising securing the casing string in the bore with concrete continuously extending from the first end region to the second end region.

* * * * *